United States Patent [19]

Aldridge et al.

[11] 4,327,954

[45] May 4, 1982

[54] PREASSEMBLED CONNECTING AND TERMINATING APPARATUS FOR PRINTED WIRING BOARDS

[75] Inventors: Lionel D. Aldridge, Seminole; Robert Trank, Pompano Beach, both of Fla.

[73] Assignee: Burroughs Corporation, Orlando, Fla.

[21] Appl. No.: 115,627

[22] Filed: Jan. 28, 1980

[51] Int. Cl.[3] ..... H01R 21/28

[52] U.S. Cl. ..... 339/64 M; 339/176 MP

[58] Field of Search ..... 339/17 C, 64 R, 64 M, 339/176 M, 176 MP, 220 R, 220 A, 220 C, 220 L, 220 T, 221 R, 221 L, 221 M

[56] References Cited

U.S. PATENT DOCUMENTS 3,864,000 2/1975 Coller et al. ..... 339/64 M 4,089,581 5/1978 Schwindt ..... 339/176 MP

*Primary Examiner*—John McQuade

*Assistant Examiner*—Frank H. McKenzie, Jr.

*Attorney, Agent, or Firm*—Carl Fissell, Jr.; Kevin R. Peterson

[57] ABSTRACT

Preassembled connecting and terminating apparatus for connecting multiple pin-type contacts to the edge of printed circuit boards for interconnecting associated electrical circuits or circuitry thereon. Contacts are preloaded and press fitted into a connector header assembly for immediate use or shipment. The header assembly includes integral guiding and camming means permitting contact insertion or removal from the top or the bottom of the header without the inconvenience of dismounting the assembly. This permits the connector header to be dismounted without disturbing the preload feature thereby avoiding damage to the contacts or the header. Integral means is provided enabling the contacts to be press fitted into holes in the printed circuit board in spite of partial misalignment between contact and hole without damage to the board or to the contacts. Means is also provided permitting the header to receive a contact insertion tool for press fitting contacts into connector header, and also permanently attaching the contacts to the associated printed circuit board, by press fitting.

3 Claims, 10 Drawing Figures

PREASSEMBLED CONNECTING AND TERMINATING APPARATUS FOR PRINTED WIRING BOARDS

BACKGROUND OF THE INVENTION

1. Field of the Invention

The invention relates to a backpanel printed circuit board connection apparatus for pressed-in compliant or wave soldered P-C board contact connection.

2. History of the Prior Art

In the past, in order to make the fabrication of multiple contact assemblies easier, faster and more efficient, the electrical contacts were first staked into the printed wiring subassembly and thereafter a dielectric or insulating housing member was placed over the top of the fixed connections. While this type of construction enables all of the contacts to be preloaded simultaneously and to exert a desired pressure against the interconnection surface, it suffers from some serious problems not the least of which is the fact that should it be necessary or desirable to remove one or more of the contacts, the contacts are trapped against withdrawal from the printed circuit board inasmuch as each contact is physically constrained behind a shoulder in the connector header as seen most clearly in U.S. Pat. No. 3,671,917. Thus, the dielectric cover must be removed in order to remove one or more pins from the backboard. This is necessarily time and energy consuming as well as difficult and lacking in automaticity. In addition, there is the ever present danger of breakage and/or rupture of the circuit board contact interconnecting printed wiring harnesses.

U.S. Pat. No. 3,963,293 illustrates a construction aimed at alleviating this problem. However, soldering of contacts to the P-C board is featured and no insertion tool means is incorporated in the combination. No preassembly for shipping or handling is possible and P-C board hole versus contact misalignment is not compensated for.

The present invention avoids these and associated problems by providing a connector header open at the top and bottom into which the electrical pin contacts are press fitted and preloaded. Integral camming as well as guide means separate the contacts both on insertion and removal while the elongated, parallel guide members enable the connectors to slide easily into the header permitting the rapid assembly of multiconnections thereafter. Outboard tangs on each contact are slidably receivable behind adjacent parallel guides to retain the contacts in preloaded condition. Individual contacts are simply and easily removable from the top of the connector header or with the header dismounted the contacts may be removed from the bottom thereof. Reinsertion of contacts is easily and simply accomplished through the integral camming ramps permitting repair and replacement of contacts at will.

SUMMARY OF THE INVENTION

The invention relates to an edge connector for a printed wiring backpanel circuit board wherein a dielectric connector header or housing is provided with a plurality of individual contact receiving slots having adjacent parallel guides therein and associated camming ramps intermediate each pair of contact receiving guide means and wherein each contact receiving aperture is tapered effective to preload each contact upon insertion into the header and to guide the contacts into the designated pin receiving aperture in spite of hole misalignments within the backpanel board. The connector header and contact combination of the present invention permits contacts to be replaced individually, without removing the header or conversely the connector header may be removed completely from the backpanel and dismounted from the inserted pins for circuit repair without disturbing any of the individual pins.

In contrast to the prior art made of reference herein the present invention utilized soldering only as a repair technique since solder is unnecessary for good electrical and mechanical connection. The disclosed device incorporates an insertion tool which makes possible an extremely efficient and rapid assembly of contacts within the header connector. The present structural combination enables preassembly of contacts within the header connector so that complete assemblies can be shipped rather than loose pieces or strip contacts and loose header connectors. Guides integral with the header prevent misalignment of replacement and/or repair contacts. The novel construction as described and claimed herein provides a two-stage frictional retention of the contacts. In the first stage the contact is restrained longitudinally, then, as the contact approaches the full seated position, it is held on the faces of the contact. This arrangement compensates for misalignment between the P-C board hole axes and the header cavity center line.

DESCRIPTION OF A PREFERRED EMBODIMENT OF THE INVENTION

Figure 1:
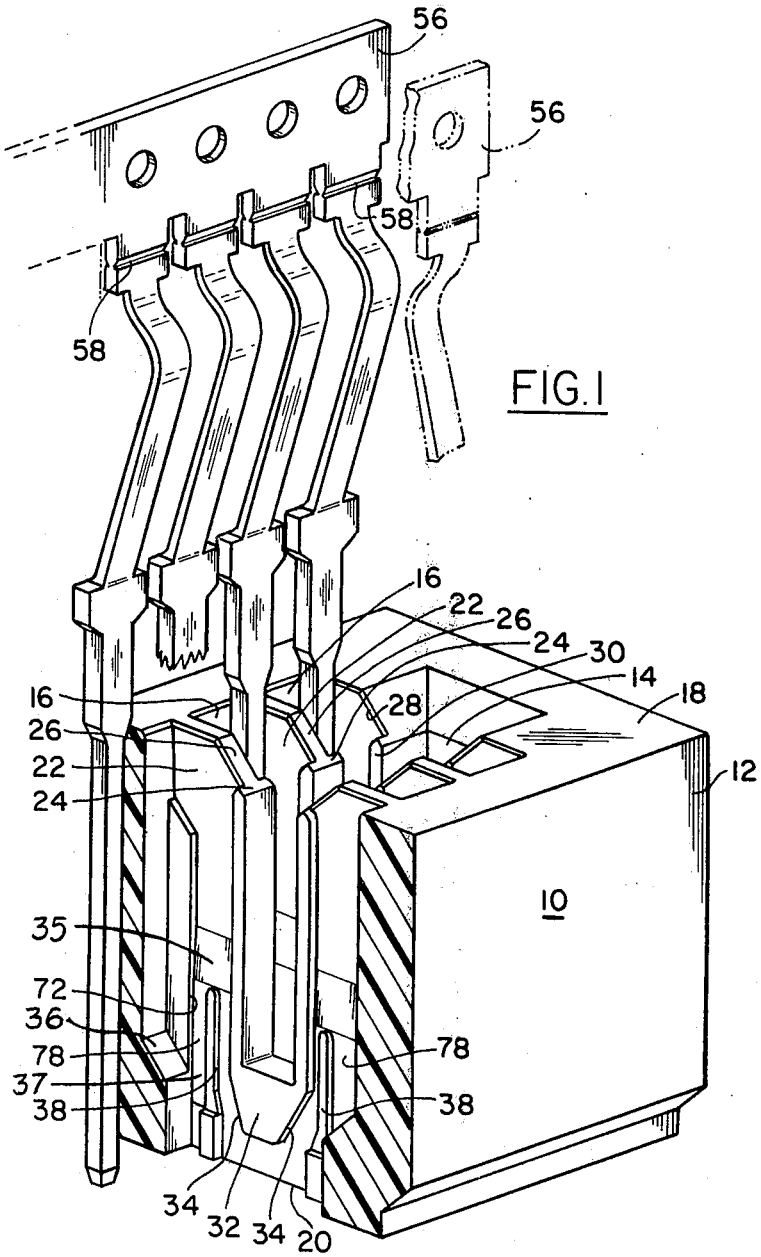
FIG. 1 is a partial isometric view of the electrical connector contact pins being inserted within the dielectric connector header illustrating the attached carrier strip prior to removal from the contacts.
Figure 3:
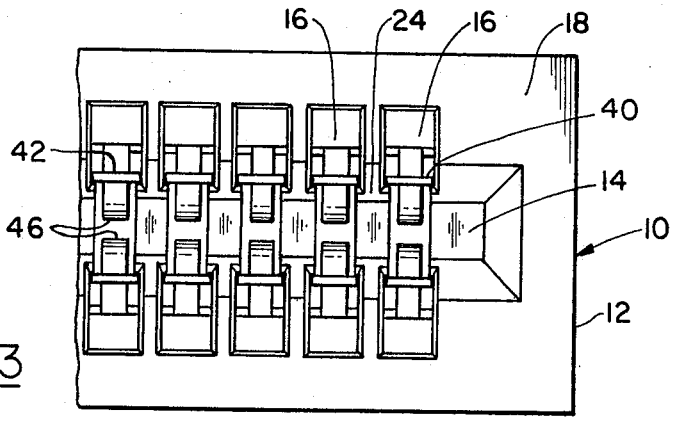
FIG. 3 is a top plan view of a portion of the dielectric, connector header with the pins inserted therein.

In accordance with the teachings of the present invention there is shown in FIG. 1 a structural arrangement providing a novel interconnection and termination apparatus for interconnecting the various electrical circuits (not shown) of a printed circuit board with other operably associated components and/or circuits (not shown). Electrical circuit connector header 10, as illustrated in the isometric view of FIG. 1, is seen to comprise a rectangular body portion 12 of insulating-dielectric material (non-conductive plastic) molded, extruded or formed to define a centrally disposed, elongated opening 14 extending from end to end thereof and a plurality of oppositely confronting pairs of substantially rectangular, vertically disposed slots, channels or open face chambers, 16, each of which extends downwardly from the top surface 18 of member 10 opening out through the bottom 20 of this member. Adjacent side walls 22 of each slot 16 (except the extreme ends) terminate forwardly in a "T" shaped ridge or guide 24 (as viewed in the top plan view of FIG. 3) with the upper inboard end of each side wall being canted downwardly as indicated at 26 as is the entire inner open area of the upper face of member 10 for easy guidance and acceptance of a printed circuit board as will be identified and described later on herein. The extreme opposite inner end walls, only one wall 28 being shown in full, of member 10 (of which there are four) are each provided with an elongated vertical ridge or guide member 30 complimenting the adjacent parallel guide members 24 and extending downwardly away from the "T" shaped top. Ridges or guides 24 terminate at the inboard bottom portion of opening 14 in a spatula or spade shaped camming member 32, the opposite edges 34 of which are angled inwardly, downwardly toward one another as shown in the various figures of the drawing for purposes to be explained shortly. The rear outboard portion of the vertical wall forming each slot 16 terminates in a downwardly angled ridge 36, for purposes to be described later on herein.

Figure 9:
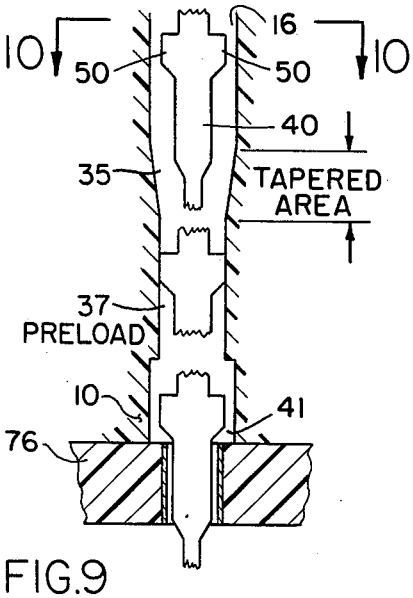
FIG. 9 is a greatly enlarged schematic illustration (not to scale) taken along the line 9—9 of FIG. 8.
Figure 10:
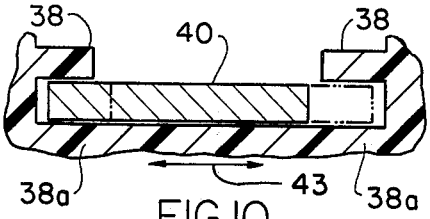
FIG. 10 is an enlarged cross-section detail view of the bottom area of one contact receiving channel illustrating the contact restraint along the line 10—10 of FIG. 9.
Figure 8:
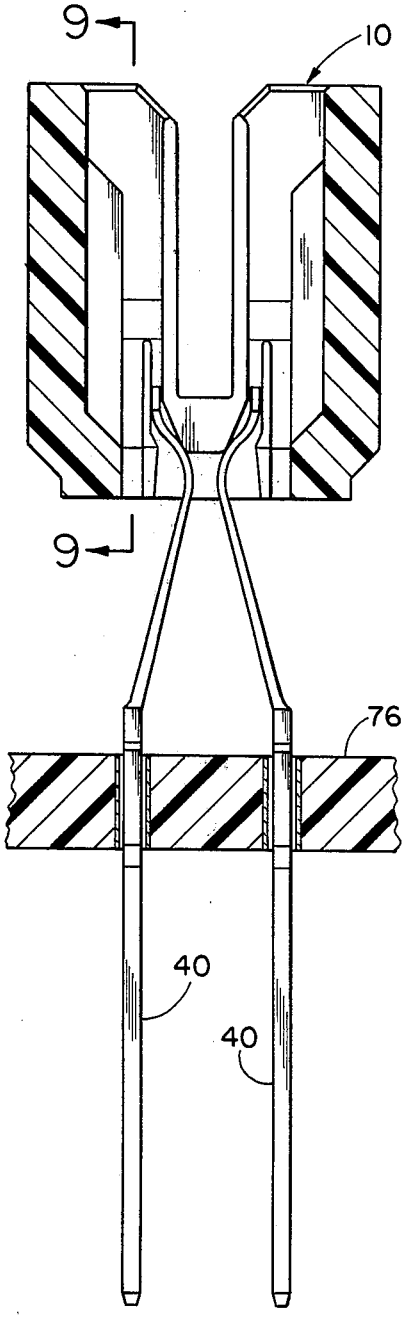
FIG. 8 is a view of the connector header in partial assembly relationship with the contacts illustrating the camming action that is provided therein with respect to the adjacent electrical pin connectors.

Approximately midway down the two side walls (those pairs in confronting relation) is an inwardly tapered portion 35 leading to a constricted area 37 (seen most clearly in FIG. 9) of sufficient extent to offer sliding resistance to the ingress of contact 40 and restrain for a short distance the sidewise movement thereof in the direction of the two-headed arrow 39 (FIG. 2), as will be described shortly. Immediately below the constricted area 37 the channel or chamber 16 opens out abruptly as at 41 (FIG. 9). At this point in its travel contact 40 is constrained against movement in a fore and aft or front and back direction (arrow 43, FIG. 10) by wall portions 38 and **38*a* (wall 38*a* is not visible in FIG. 1 since the section is cut through just ahead of the mating wall structure). In this latter position or location within the header-connector 10** the contact is permitted a certain degree of sidewise movement thus permitting it to align itself with any misaligned P-C board hole while being constrained against front to back movement.

Extending upwardly from the bottom 20 of member 10 at the base of each slot 16 are oppositely disposed raised guide projections 38 slightly inwardly canted or angled at the top as seen most clearly in FIGS. 4 through 8 inclusive, for purposes to be explained shortly.

Figure 2:
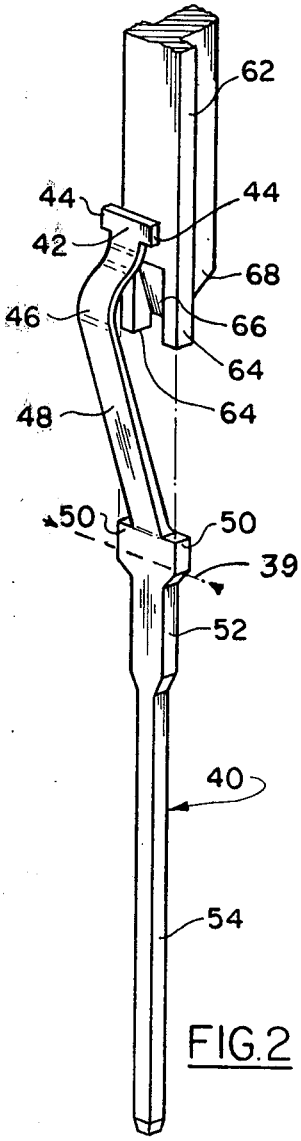
FIG. 2 is an isometric view of an individual contact pin illustrated in conjunction with a portion of press fit insertion tool.

Electrical circuit contact pins 40 for reception within header connector 10 are seen to comprise substantially elongated stamped, pressed, or formed members as illustrated in FIG. 2 and include a straight, flat portion 42 having oppositely extending ears or tangs 44 and a compound curved portion or crown 46, a substantially straight portion 48 depending therefrom and having a pair of oppositely disposed shoulder portions 50 below which is arranged a slightly enlarged neck portion 52 terminating in a neck down shank portion 54.

Contact pins 40 are formed and shaped from elongated flat sheet metal coiled strip. A carrier strip 56 FIG. 1, resulting from the forming operations supports a plurality of pin contacts 40 which depend therefrom and from which each is separable along a formed sheer line 58 in a subsequent operation.

Figure 5:
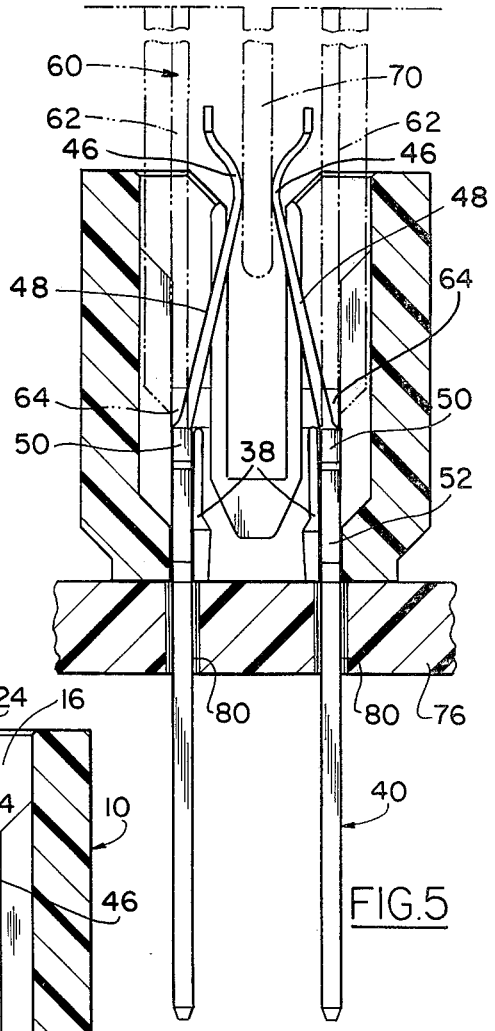
FIG. 5 is a sectional view of the connector header partially assembled to the printed wiring backpanel and illustrating in phantom the tool assembly for placing the individual contacts in electrical contact connection with the circuit on the printed wiring panel.

An insertion tool 60, FIG. 5, one prong 62 of which is seen in the upper portion of FIG. 2, and which is shown in dotted outline FIG. 5, is employed to press the pins 40 into the connector header 10. Tool 60 comprises a comb-like structure (not shown) wherein a plurality of tooth or prong members 62 each terminate in two parallel depending extensions 64, separated by an inwardly angled area 66. The rear depending end portion of each tooth or tang is also inwardly angled as at 68.

CONTACT INSERTION TECHNIQUE

As will become apparent as the description proceeds, a number of contact insertion or header loading operations are available to the user as a direct result of the novel structural configuration of the present invention.

Figure 4:
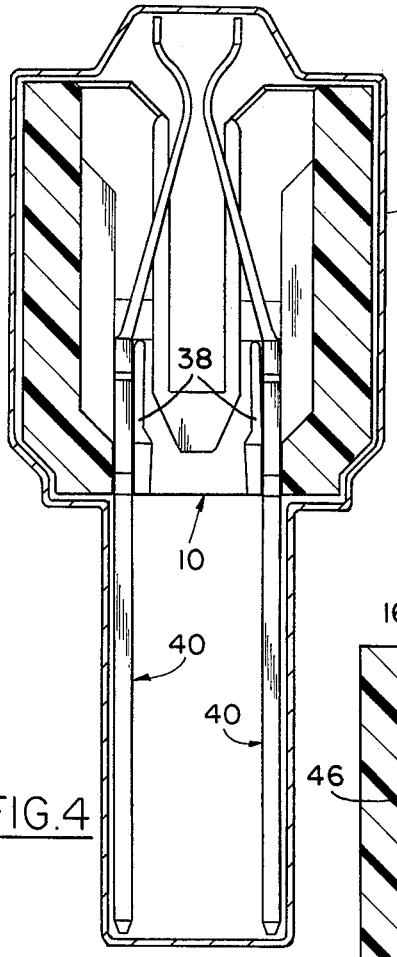
FIG. 4 is an end elevational view in partial section illustrating the connector header with the individual pins partially inserted therein and showing protective shipping container.

In certain instances it may be desirable or necessary to partially insert the contacts 40 into the header connector 10 as seen in FIGS. 4 and 5. In such case, the tool 60 is oriented such that the tines, tangs or teeth 62 slide downwardly behind each contact 40 bringing the pairs of parallel extensions or feet 64 into engagement with the pairs of oppositely disposed shoulders 50. In this regard it is noted that the canted area 66, FIG. 2, provides a clearance for the vertical downward movement of the tines of the tool while the rear inwardly canted or angled surface 68 provides clearance adjacent the angled area 36, FIG. 1. When tool 60 is to be employed the central projection 70, FIG. 5, of tool 60 enters the area between the pairs of confronting crowns 46 of pairs of contacts 40.

Downward movement of tool 60 is continued until shoulders 50 are pressed into the channel formed between the raised guide projections 38, FIG. 1, and the narrow raised area 72, FIG. 1, of the side wall of each slot 16, effectively preassembling each contact into the header 10. The press fit relationship constrains the contact pins 40 against accidental dislodgment or removal from the connector header. In this condition the header connector 10 plus the contacts can be shipped. A container-carrier 74 as seen in FIG. 4 of suitable material can be employed to surround and protect the exposed ends (top and bottom) of contacts 40. Upon receipt by the consumer-user, the header connector 10 can then be dismounted from the container ready for use.

For application to a printed circuit board 76 (P-C board) FIGS. 5 through 8 inclusive, tool 60 is once more brought into play and is again introduced into the header connector 10 so that the central projection 70 of the tool goes between the crowns 46 and the feet 64 engage the shoulders 50. Continued downward pressure on the tool 50 forces the contacts 40 to slide downwardly within the short channel areas 78 FIG. 1, parallel to the previously mentioned channel between guides 38 and areas 72 to force the rectangular area 52 of each contact 40 in their respective plated through round hole 80 in the associated printed circuit board 76. This action deforms the walls of the receiving P-C board hole to the extent that a tight press fit I.C. mechanical and electrical connection is produced without the need for soldering.

Simultaneously the central member 70 of tool 60 forces the crowns 46 apart a calculated but sufficient distance so as to cause the tangs 44—44 to seat behind and to be constrained by the "T" shaped guides 24 in the connector header.

As crowns 46—46 are forced apart, kinetic energy is stored in cantilever beam section 48 FIG. 2. This energy is retained by tangs 44 being trapped behind guides 24. Kinetic energy is thus "preloaded".

Figure 6:
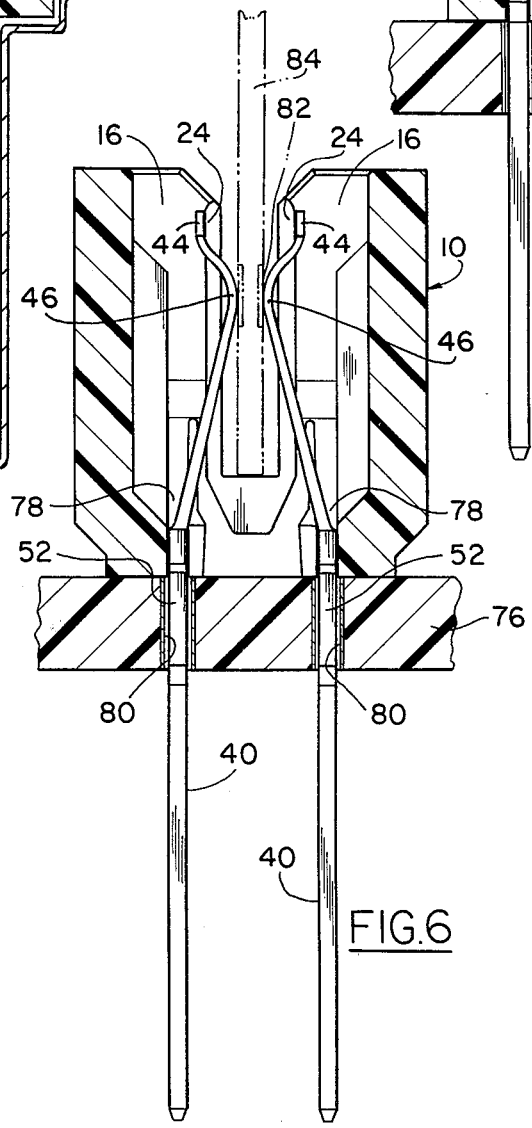
FIG. 6 is a view similar to FIG. 5 but without the phantom tool arrangement and illustrating the connector header and the contacts in assembled relationship with the printed wiring backpanel.

As seen most clearly in FIG. 6 introduction of vertically oriented P-C board 84 into the opening 14 in header connector 10 brings the crowns 46 into electrical and physical engagement with pads 82 on P-C board 84 effectively interconnecting the two P-C boards 76 and 84.

An additional and novel and extremely important feature of the present invention is the capability of the present novel connector header 10 to permit physical removal of the contacts 40 upwardly out through the top of the connector header should this be necessary or desirable or required for example to replace or repair individual contacts, or the connector header 10 may be physically removed from its contact with the P-C board and dismounted from the contacts.

Figure 7:
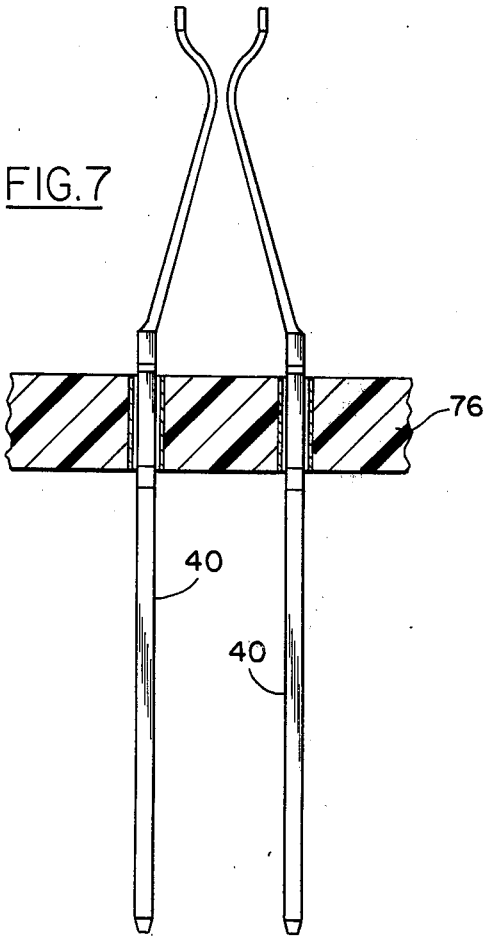
FIG. 7 is a view of the printed wiring backpanel with the pins inserted therein but with the connector header disassembled therefrom.

Finally, the connector header can be lifted from the P-C board 76, FIG. 7, by overcoming the frictional resistance created by each contact. Contacts being retained in a P-C board 76 by a much greater frictional "press fit" force. Contacts remain in P-C board, but are relatively easily withdrawn through bottom of connector header. No damage to header, or contacts takes place, the header can be replaced over contacts and pressed home to again retain header, FIG. 8.

What is claimed is:

1. A connector terminator device for edge contact printed circuit boards wherein the boards are adapted to carry printed wiring contact pads for mating engagement with external connector contacts comprising, an insulated housing for mounting electrical circuit contacts therein and for permitting insertion and removal of said electrical contacts therefrom in two opposite directions without damage to either the housing or the contacts, said housing including an outer box-like shell having side walls and being open at the top and bottom to permit said housing to receive said contacts through the top for inter engagement with the contact pads of said printed circuit board while enabling either said housing to be removed from said contacts and said printed circuit board or said contacts to be removed separately or en masse through the top or bottom of said housing, said housing further comprises a plurality of confronting pairs of substantially rectangular elongated channels separated by a longitudinal opening for receiving a printed circuit board carrying a plurality of electrical contact circuit pads thereon and wherein each adjacent pair of channels includes an inwardly tapered portion leading directly to a constricted area for guiding and constraining a portion of each contact which may be inserted in the said channel thereby effectively preventing accidental dislodgment or disengagement of the contact and wherein said constricted area opens abruptly outwardly permitting limited freedom of movement of said contact;

means integral with said housing permitting frictional engagement of said contacts with said housing while tolerating misalignment between said contacts and the receiving openings in an insulative substrate, and an insulative substrate including contact receiving openings into which the contacts within said housing are adapted to be electrically and mechanically connected and mounted and to which said housing is disposed in contact engagement.

2. The invention in accordance with claim 1, wherein said insulated housing further includes oppositely disposed channels parallelling each of said contact receiving channels and being tapered at the bottom ends thereof for receiving and constraining an insertion tool adapted to press fit the contacts into an associated printed wiring board with which the insulative housing may be operably associated.

3. The invention in accordance with claim 1, wherein each said contact comprises a continuous one piece uninterrupted flat elongated conductive member having a rectangular cross-section throughout substantially half its length and normal to the long dimension of said contact, the lower surfaces of said shoulder portions being angled upwardly outwardly into a pair of rectangular shoulder portions and a portion gradually curving outwardly away from the main plane of said contact including a crown portion at the point of maximum curvature terminating in a reversely curved portion having a pair of oppositely disposed tangs normal to the long dimension of said contact.

* * * * *